United States Patent [19]

Slater

[11] 4,108,316

[45] Aug. 22, 1978

[54] INTERCONNECTIBLE STRUCTURAL TUBULAR MEMBERS

[75] Inventor: Norman S. Slater, Montreal, Canada

[73] Assignee: Norman Slater, Inc., Montreal, Canada

[21] Appl. No.: 672,394

[22] Filed: Mar. 31, 1976

[51] Int. Cl.[2] ..... A47F 5/13

[52] U.S. Cl. ..... 211/199; 40/610, 211/182; 211/188; 211/189; 248/165

[58] Field of Search ..... 211/186, 194, 199, 148, 211/177, 181, 182, 188, 189; 248/166, 167, 127, 150, 188.1, 188.6, 165; 108/153; 46/27-29; 40/125 R, 125 F, 125 G, 125 H, 125 K, 128, 129 R; 160/135, 351

[56] References Cited

U.S. PATENT DOCUMENTS

| | | | |
|---|---|---|---|
| 2,529,649 | 11/1950 | Coplen | 211/188 X |
| 2,896,789 | 7/1959 | Saus et al. | 211/182 X |

FOREIGN PATENT DOCUMENTS

| | | | |
|---|---|---|---|
| 952,140 | 4/1949 | France | 211/186 |
| 990,604 | 9/1951 | France | 108/12 |
| 804,886 | 5/1951 | Fed. Rep. of Germany | 211/189 |
| 2,404,273 | 8/1975 | Fed. Rep. of Germany | 248/188.1 |
| 565,854 | 12/1957 | Italy | 248/165 |
| 420,209 | 4/1947 | Italy | 211/189 |
| 906,725 | 9/1962 | United Kingdom | 211/177 |
| 1,266,758 | 3/1972 | United Kingdom | 211/194 |

*Primary Examiner*—Roy D. Frazier
*Assistant Examiner*—Terrell P. Lewis
*Attorney, Agent, or Firm*—Charles E. Brown

[57] ABSTRACT

An interconnectible structural support member for use in a support structure. The support member comprises an elongated U-shape tubular member defining opposed side arms and a bridge arm extending across a common end of each of the side arms. Each of the side arms have a free end with one of the free ends having a hinge plug protruding therefrom. The other free end is hollow and receives a hinge plug of a side arm of a further U-shape tubular member.

3 Claims, 5 Drawing Figures

INTERCONNECTIBLE STRUCTURAL TUBULAR MEMBERS

BACKGROUND OF THE INVENTION a. Field of the Invention

The present invention relates to structural support members for use in a support structure which is orientable to a desired pattern and having a plurality of uses.

b. Description of Prior Art

Interconnectible structural support members consisting of tubular type sections of rectangular configuration and for use in a support structure for the construction of display frames are known. Each such structures normally consist of four interconnectible arms two of which are opposed parallel end arms and the other two are opposed parallel side arms. The structures are interconnected with an adjacent structure by means of connecting links rigidly secured between two adjacent arms. With this type of structure two rectangular frames are immovably secured in fixed position to one another and in order to secure the frames in position and to dismantle them it is necessary to fasten and unfasten connecting links. Further, these connecting links are sometimes misplaced when the framework structure is shipped to its destination thus making the erection of the display framework more time consuming and difficult. Still further, such framework is of long length when sections are preassembled and results in a bulky package which is cumbersome to handle and transport. Furthermore, such framework cannot easily be adaptable for use as support structures for other purposes such as furniture construction, shelving, etc.

SUMMARY OF INVENTION

It is a feature of the present invention to provide an interconnectible structural support member for use in a support structure and which consists essentially of an elongated U-shape tubular member adaptable to be connected with a plurality of identical U-shape tubular members whereby to form a structural framework of substantially elongated U-shape configuration to form peripheral frames serially and hingeably connected to each other whereby these are serially foldable (accodion fashion) into a package for shipping and easily extended to form an irregular array of peripheral frames for supporting connectible units within the frames.

It is a still further feature of the present invention to provide an interconnectible structural support member for the construction of peripheral frames which is substantially economical to construct and does not require special skills to assemble and disassemble.

According to the above features, from a broad aspect, the present invention provides an interconnectible structural support member comprising an elongated U-shape tubular member defining opposed side arms and a bridge arm extending across a common end of each side arm. Each side arm has a free end, one of which has a hinge plug protruding therefrom and the other being hollow to receive a hinge plug of a side arm of a further U-shape tubular member.

BRIEF DESCRIPTION OF DRAWINGS

Ths invention will now be described with reference to a preferred embodiment as illustrated by the accompanying drawings in which.

DESCRIPTION OF PREFERRED EMBODIMENTS

Figure 1:
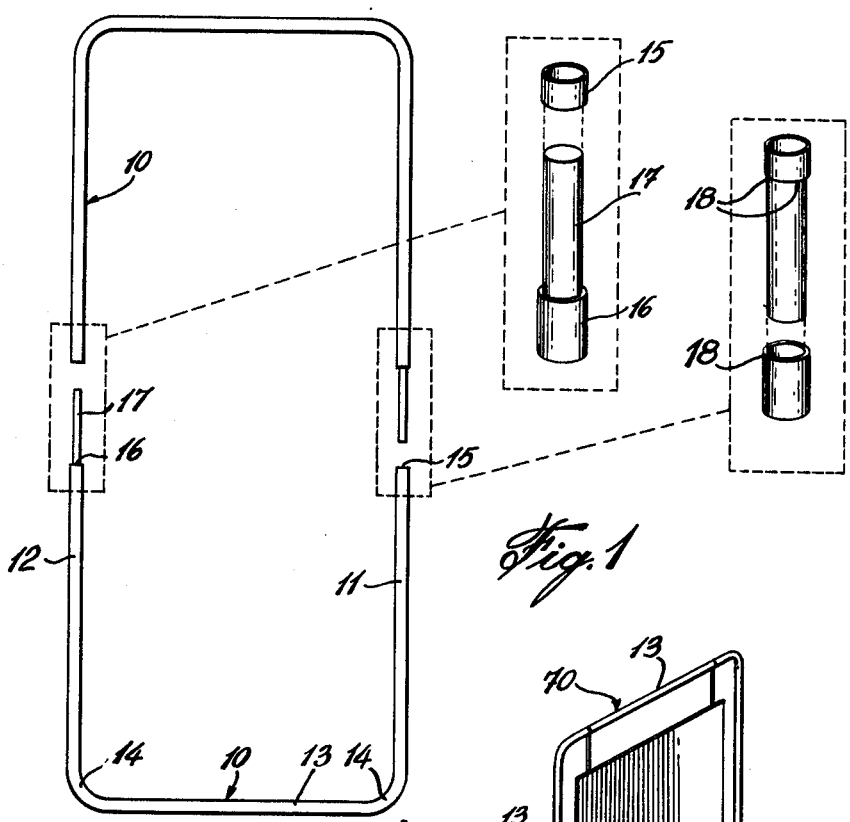
FIG. 1 is a side view, showing portions thereof in exploded form and in perspective, illustrating the interconnectible structural support member of the present invention.

Referring now to the drawings and more particularly to FIG. 1 there is shown the construction of the structural support member and consisting essentially of an elongated U-shape tubular member 10. The member 10 is formed of an elongated hollow pipe which is bent to form a U-shape and thereby defines opposed side arms 11 and 12 and a bridge arm 13 integral therewith. The bridge arm 13 extends across a common end of the side arms defined by the corners 14 of each side arm 11 and 12.

The side arm 11 has a free end 15 which is hollow and of tubular cross-section. The side arm 12 has a free end 16 which is provided with a hinge plug 17 protruding therefrom a predetermined distance. The hinge plug 17 is herein shown as a plug formed, for example by a section of a hollow or solid rod of circular cross-section, and constructed of steel or any other suitable material, and affixed within the free end 16 of the arm 12. The side arms 11 and 12 are also of substantially equal length.

Preferably, but not exclusively, the peripheral edge 18 of the free ends 15 and 16 may have a taper which slopes outwardly downward of its respective side arm. The reaction for this is to reduce friction to facilitate rotation of interconnected U-shape tubular members as described hereinafter. Three or more of the interconnectible structural U-shape support members 10 may be interconnected together to form support structures for many uses as illustrated in the examples shown in FIGS. 2 to 5. The hollow end 15 of side arm 11 is dimensioned to receive the hinge plug 17 of a further U-shape tubular member 10, in close frictional fit therein whereby to permit axial rotation of the plug 17 therein and thus of two interconnected side arms. The plug 17 may also be greased to facilitate rotation by reducing friction.

Figure 2:
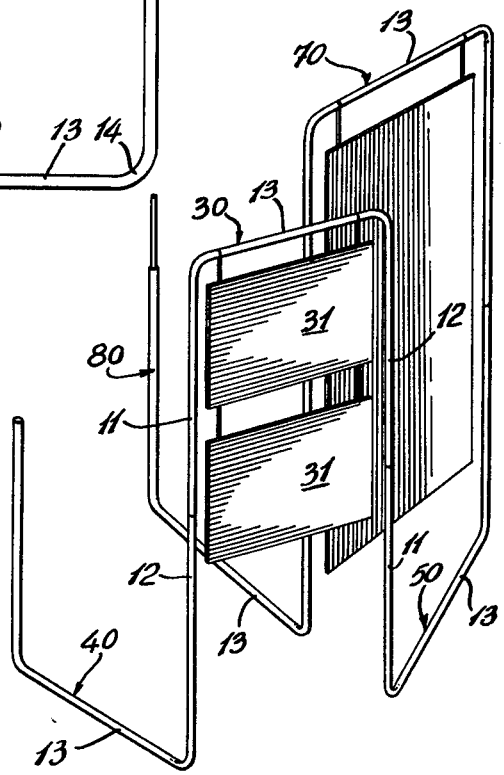
FIG. 2 is a perspective view showing a support structure formed of interconnectible structural support members.

As shown in FIG. 2 a second U-shape member 30 is hingeably connected to a first and third U-shape support member 40 and 50, respectively. This interconnection is done by placing the hinge plug (not shown) of the side arm 12 of the first member 40 in the hollow end (not shown) of the side arm 11 of the second member 30. The hinge plug in the other side arm 12 of the second member 30 is inserted in the hollow end of the side arm 11 of the third U-shape member 50. Additional U-shape frame members 70 and 80 may be interconnected in the same manner and in a series arrangement as shown in FIG. 2. With this type of structure it is noted that some of the bridge arms 13 are supported upwardly by support bridge arms 13 which lie on a ground surface.

With the structure as shown in FIG. 2 it is noted that there is formed a plurality of peripheral frames of substantially elongated U-shape and inverted U-shape configuration providing a means to secure all forms of connectable units between its side arms. The connectable units could be in the form of boxes, shelves, display panels such as shown at 31, either hung from the bridge arm 13 or secured to the side arms 11 and 12.

When it is desired to transport the support structure as shown in FIG. 2 it is only necessary to displace each of the peripheral frames on their hinge connections to collapse them in an accordian fashion, one on top of the other in a serial array, although not illustrated but obvious to one skilled in the art. Of course, the structure can be dismantled in sections and shipped in bundles compactly stacked.

Figure 3:
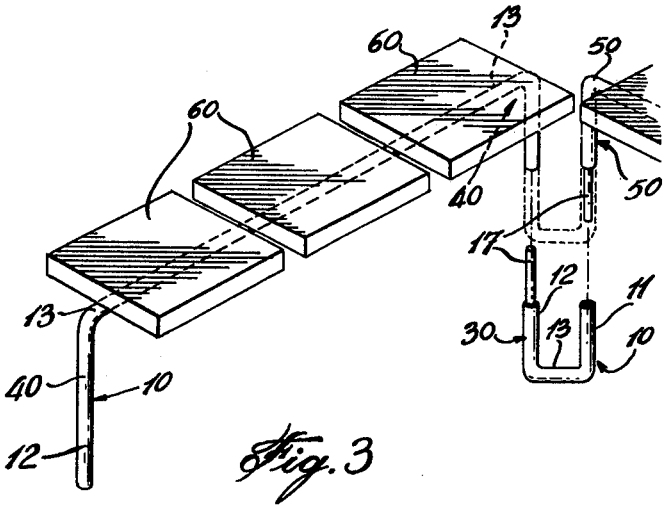
FIG. 3 is a perspective view showing a portion thereof in exploded form and illustrating a further type support structure incorporating interconnectible structural support members of the present invention.

Referring now to FIG. 3 there is shown another application of the U-shape tubular member 10. As hereinshown the side arms 11 and 12 of the first members 40 are of different lengths. The bridge arms 13 of the first, second and third members may also be of different lengths, The interconnection between the U-shape members is made in the same manner as described hereinabove, that is via the hinge plug 17 as illustrated in the exploded view. As shown in FIG. 3 one or more natural support members 60 herein constituting seats, are secured to the bridge arm 13 of the first U-shape member 40 and extend substantially transverse to the side arms 11 and 12. The outside side arm of the members at the end of the structure are secured rigidly on a surface. Thus, it can be seen that the U-shape tubular member can be used in a frame structure for the construction of furniture or the like structures.

Figure 5:
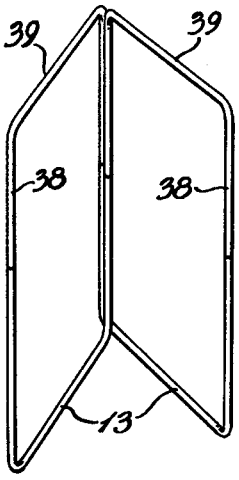
FIG. 5 is a perspective view showing a support structure similar to that of FIG. 4 and in a further position of use.
Figure 4:
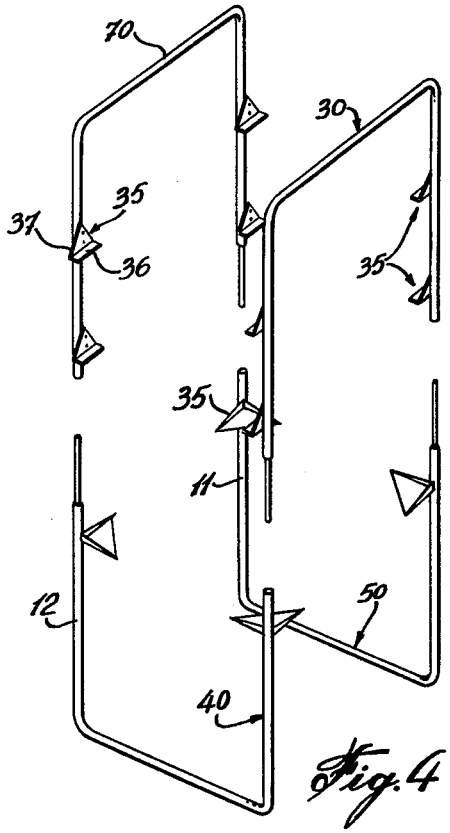
FIG. 4 is a perspective view, in exploded form, illustrating a further type support structure incorporating interconnectible structural support members of the present invention.

Referring now to FIGS. 4 and 5 there is shown a fourth U-shape structural member 70 connected between the side arm 12 of the first member 40 and the side arm 11 of the third member 50 whereby to constitute an endless peripheral frame structure. This type of peripheral frame structure may be used as a shelving support structure and for this purpose each side arm is provided with a support plate 35 rigidly or adjustably secured thereto. FIG. 4 shows two of such type of support plates 35 and these are herein shown as having a support suface defined by plate 36 and an attachable plate 37. The support plate 36 and attachable plate 37 can be of various shapes as illustrated in FIG. 4. These support plates are in planar alignment whereby to support a shelf (not shown) between four plates lying in the same plane.

FIG. 5 shows the support structure of FIG. 4, without the support plates 35 but with two of opposed or second ones of the vertical arms 38 being brought in close proximity to one another. This is made possible by the hinge connection between the side arms which form the vertical arms 38. By bringing two of such opposed vertical arms 38 close together there is formed two adjacent peripheral frames 39 which appear rectangular and which are self-supporting due to the angle between the peripheral frames 39 or the lower bridge arms.

As above described it is possible to provide various types of support structures by hingeably interconnecting a plurality of the U-shape tubular members of the present invention. Also, the length of the arms and the cross-section of the tubular members can be varied whereby to vary the appearance of a support struture and it is within the ambit of the present invention to cover any obvious modification of structures constructed with these tubular members provided these fall within the ambit of the invention as defined by the appended claims.

I claim:

1. A support structure comprising three or more interconnectible structural support members, each support member consisting of an elongated unitary U-shape tubular member of uniform cross-section shaped to define opposite side arms and a bridge arm extending across a common end of each said side arms, each of said side arms having a free end, one of said free ends having a hinge plug of circular cross-section rigidly secured thereto and protruding therefrom, the other free ends being hollow and of circular cross-section to receive a hinge plug of a side arm of a further U-shape tubular member, a second one of said support members being hingeably connected to a first and third one of said support members by receiving said hinge plug of a side arm of said first member in said hollow end of a side arm of said second member and having said hinge plug of the other side arm of said second member received in said hollow end of a side arm of said third member, said bridge arm of said second member being supported upwardly of a support surface by said bridge arms of said first and third members which are resting on said support surface, each of said hinge plugs being received in the hollow free end of the respective side arm in close frictional fit to permit axial rotation of respective ones of said interconnected side arms about said hinge plug in said respective hollow end whereby said interconnected ones of said support members will be self-supporting on said supporting surface and displaceable relative to one another and to any desired position when in use, said side arms being of substantially equal length, each of said side arms being provided with a support plate having a support surface extending tranversely to the longitudinal axis of said side arms.

2. A support structure comprising three or more interconnectible structural support members, each support member consisting of an elongated unitary U-shape tubular member of uniform cross-section shape to define opposite side arms and a bridge arm extending across a common end of each said side arms, each of said side arms having a free end, one of said free ends having a hinge plug of circular cross-section rigidly secured thereto and protruding therefrom, the other free ends being hollow and of circular cross-section to receive a hinge plug of a side arm of a further U-shape tubular member, a second one of said support members being hingeably connected to a first and third one of said support members by receiving said hinge plug of a side arm of said first member in said hollow end of a side arm of said second member and having said hinge plug of the other side arm of said second member received in said hollow end of a side arm of said third member, said bridge arm of said second member being supported upwardly of a support surface by said bridge arms of said first and third members which are resting on said support surface, each of said hinge plugs being received in the hollow free end of the respective side arm in close frictional fit to permit axial rotation of respective ones of said interconnected side arms about said hinge plug in said respective hollow end whereby said interconnected ones of said support members will be self-supporting on said supporting surface and displaceable relative to one another and to any desired position when in use, one side arm of said first member being longer than the other side arm and substantially equal to the combination of the length of its other side arm and the hingeably interconnected side arm of said second member, one or more lateral support members secured to said bridge arm of said first member and having a planar surface extending transversely to said side arms of said first member.

3. A support structure comprising three or more interconnecting structural support members, each support member consisting of an elongated unitary U-shape tubular member of uniform cross-section shaped to define opposite side arms and a bridge arm extending across a common end of each said side arms, each of said side arms having a free end, one of said free ends having a hinge plug of circular cross-section rigidly secured thereto and protruding therefrom, the other free ends being hollow and of circular cross-section to receive a hinge plug of a side arm of a further U-shape tubular member, a second one of said support members being hingeably connected to a first and third one of said support members by receiving said hinge plug of a side arm of said first member in said hollow end of a side arm of said second member and having said hinge plug of the other side arm of said second member received in said hollow end of a side arm of said third member, said bridge arm of said second member being supported upwardly of a support surface by said bridge arms of said first and third members which are resting on said support surface, each of said hinge plugs being received in the hollow free end of the respective side arm in close frictional fit to permit axial rotation of respective ones of said interconnected side arms about said hinge plug in said respective hollow end whereby said interconnected ones of said support members will be self-supporting on said supporting surface and displaceable relative to one another and to any desired position when in use, a connectable unit being secured below said bridge arm of said second member and between the hingeably interconnected side arms thereof.

* * * * *